US008593046B2

(12) United States Patent
Kodama et al.

(10) Patent No.: US 8,593,046 B2
(45) Date of Patent: Nov. 26, 2013

(54) SPARK PLUG HAVING A NOVEL NICKEL COATING FOR THE METAL SHELL

(71) Applicant: NGK Spark Plug Co., LTD., Aichi (JP)

(72) Inventors: Kazuhiro Kodama, Aichi-ken (JP); Hiroaki Nasu, Gifu-ekn (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/762,723

(22) Filed: Feb. 8, 2013

(65) Prior Publication Data

US 2013/0214669 A1 Aug. 22, 2013

(30) Foreign Application Priority Data

Feb. 16, 2012 (JP) ..... 2012-031362

(51) Int. Cl.
*H01T 13/39* (2006.01)

(52) U.S. Cl.
USPC ..... 313/141; 313/143; 313/145

(58) Field of Classification Search
USPC ..... 313/118–445; 123/169 R, 32, 41, 310
See application file for complete search history.

(56) References Cited

U.S. PATENT DOCUMENTS

| | | | | |
|---|---|---|---|---|
| 6,768,249 | B1 * | 7/2004 | Nasu et al. | 313/118 |
| 7,122,947 | B2 * | 10/2006 | Nasu et al. | 313/141 |
| 2013/0175917 | A1 * | 7/2013 | Kodama et al. | 313/141 |

FOREIGN PATENT DOCUMENTS

| | | | |
|---|---|---|---|
| JP | 2002-184552 | 6/2002 | F02P 13/00 |
| JP | 2006-236906 | 9/2006 | H01T 13/20 |

* cited by examiner

*Primary Examiner* — Tracie Y Green
(74) *Attorney, Agent, or Firm* — Kusner & Jaffe

(57) ABSTRACT

A spark plug includes a tubular metal shell extending in an axial direction, wherein the metal shell includes: an externally threaded portion formed on a tip end side of an outer periphery of the metal shell; a seat portion formed on a rear end side of the externally threaded portion in the axial direction and protruding radially outward; and a nickel layer provided on an outer surface of the metal shell, wherein the nickel layer contains phosphorus, and a phosphorus concentration in a portion in which a nickel concentration is 50 at % in a thickness direction of the nickel layer itself is 6 at % or more and 20 at % or less.

6 Claims, 4 Drawing Sheets

SPARK PLUG HAVING A NOVEL NICKEL COATING FOR THE METAL SHELL

CROSS-REFERENCE TO RELATED APPLICATION

This application is based on Japanese Patent Application No. 2012-031362 filed with the Japan Patent Office on Feb. 16, 2012, the entire content of which is hereby incorporated by reference.

FIELD OF THE INVENTION

The present disclosure relates to a spark plug for use in an internal combustion engine or the like.

BACKGROUND OF THE INVENTION

A spark plug is mounted on, for example, an internal combustion engine (an engine). In this case, the spark plug is used to ignite an air-fuel mixture in a combustion chamber. Generally, the spark plug includes an insulator having an axial hole, a center electrode, a tubular metal shell main body, and a ground electrode. The center electrode is inserted into the tip end side of the axial hole of the insulator. The metal shell main body is provided on the outer periphery of the insulator. The ground electrode is joined to the metal shell main body. A gap between the ground electrode and the center electrode is a spark discharge gap.

In order to improve the corrosion resistance of the metal shell main body, a nickel layer can be provided on the surface of the metal shell main body. The nickel layer includes a metal having nickel as a principal component. A method for providing a nickel layer is disclosed in, for example, JP-A-2002-184552. In the method, a metal shell main body is immersed in a predetermined plating aqueous solution. After immersion, the metal shell main body is energized for a predetermined time period.

SUMMARY OF THE INVENTION

A spark plug includes a tubular metal shell extending in an axial direction, wherein the metal shell includes: an externally threaded portion formed on a tip end side of an outer periphery of the metal shell; a seat portion formed on a rear end side of the externally threaded portion in the axial direction and protruding radially outward; and a nickel layer provided on an outer surface of the metal shell, the nickel layer contains phosphorus, and a phosphorus concentration in a portion in which a nickel concentration is 50 at % (atomic percent) in a thickness direction of the nickel layer itself is 6 at % or more and 20 at % or less.

BRIEF DESCRIPTION OF THE DRAWINGS

FIG. 4 is a partially enlarged cross-sectional view of a trivalent chromate layer, an antirust oil layer, and the like; and FIG. 5 is a partially enlarged cross-sectional view of a nickel layer, an anti-seizing agent, and the like.

DETAILED DESCRIPTION OF THE INVENTION

Figure 1A:
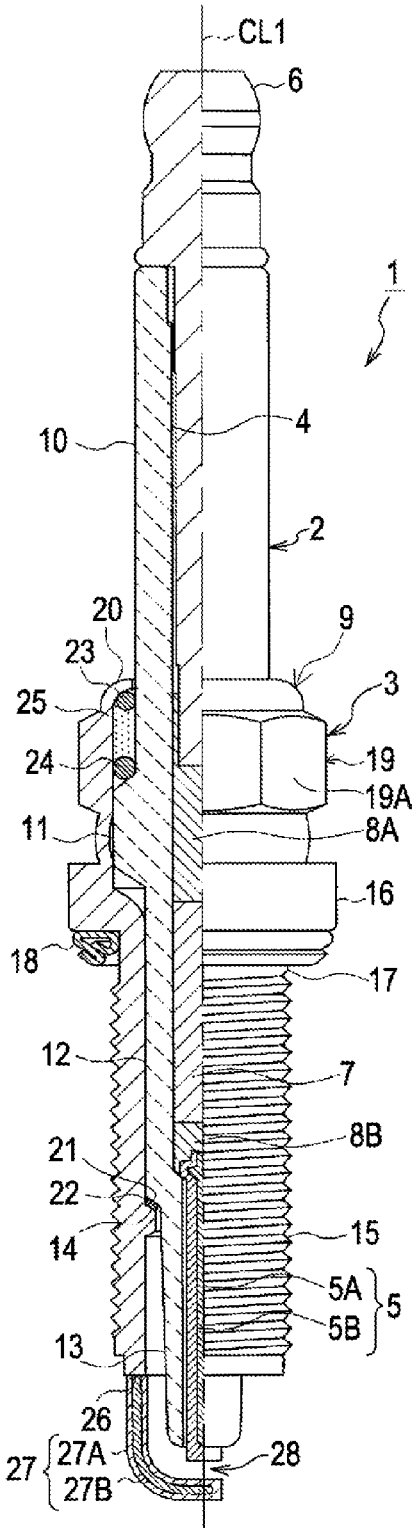
FIG. 1A is a partial sectional front view of the configuration of a spark plug.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

From the viewpoint of further improving the corrosion resistance of a metal shell main body, preferably, the grain size of crystal grains is made relatively smaller by suppressing the grain growth of the crystal grains included in a nickel layer. The smaller the grain size, the greater the proof strength of the nickel layer against stress. Thus, micro cracks to be penetration paths for acid or the like do not tend to be formed in a nickel layer. For a method for reducing the grain size of crystal grains, it is considered to reduce the density of an electric current for use in forming a nickel layer. Furthermore, in the case of reducing the electric current density, in order to form a nickel layer in a sufficient thickness, immersion time (energization time) for a metal shell main body in a plating aqueous solution is set relatively long (for about one hour, for example).

However, when immersion time is made longer, the deterioration of productivity may occur. On the other hand, when immersion time is made shorter in order to suppress the deterioration of productivity, it is likely to excessively reduce the thickness of a nickel layer. In this case, the corrosion resistance of a metal shell main body becomes insufficient.

An object of the present disclosure is to provide a spark plug that can effectively improve both of productivity and corrosion resistance of a metal shell main body.

Hereinafter, exemplary configurations for achieving the above object and exemplary operations and effects of the respective configurations will be described.

Configuration 1: a spark plug according to configuration 1 includes a tubular metal shell extending in an axial direction, wherein the metal shell includes:

an externally threaded portion formed on a tip end side of an outer periphery of the metal shell;

a seat portion formed on a rear end side of the externally threaded portion in the axial direction and protruding radially outward; and a nickel layer provided on an outer surface of the metal shell, the nickel layer contains phosphorus, and a phosphorus concentration in a portion in which a nickel concentration is 50 at % in a thickness direction of the nickel layer itself is 6 at % or more and 20 at % or less.

According to the configuration 1, P is contained in the nickel layer. In the nickel layer, the concentration of P in the portion in which the concentration of Ni is 50 at % (a first portion) in the thickness direction of the nickel layer is 6 at % or more. Therefore, the existence of P can effectively suppress the grain growth of crystal grains when forming the nickel layer. Thus, the grain size of crystal grains forming the nickel layer can be sufficiently made smaller. Consequently, it is possible to improve corrosion resistance.

P tends to corrode easily as compared with Ni. In the case where the P content is excessively large, it is likely that corrosion starting from P tends to occur. Regarding this point, according to the configuration 1, the concentration of P in the first portion is 20 at % or less. Thus, the occurrence of corrosion starting from P can be more reliably suppressed. Consequently, it is possible to more reliably exert the effect of improving corrosion resistance.

Moreover, generally, when a nickel layer is formed under the conditions that a nickel layer with a sufficient thickness can be formed in a relatively short immersion time, crystal grains forming the nickel layer tend to be coarse grains. On the contrary, according to the configuration 1, the existence of P can effectively suppress the grain growth of crystal grains. Thus, even though a nickel layer is formed under the conditions that a nickel layer with a sufficient thickness can be formed in a relatively short immersion time, the grain size of crystal grains can be made smaller while sufficiently securing the thickness of the nickel layer. That is, according to the configuration 1, it is unnecessary to prolong immersion time in order to, for example, reduce the grain size of crystal grains. Therefore, immersion time can be shortened. Consequently, it is possible to dramatically improve productivity.

Configuration 2: configuration 2 is the spark plug according to the configuration 1, wherein the phosphorus concentration in the portion in which the nickel concentration is 50 at % in the thickness direction of the nickel layer is 8 at % or more and 15 at % or less.

According to the configuration 2, the grain size of crystal grains forming the nickel layer can more reliably be made smaller. Moreover, the occurrence of corrosion starting from P can be further suppressed. Consequently, it is possible to significantly improve corrosion resistance.

Configuration 3: configuration 3 is the spark plug according to the configuration 1 or 2, wherein the metal shell includes a trivalent chromate layer provided on the nickel layer, the trivalent chromate layer includes a chromium component, and 95 mass % or more of the chromium component is trivalent chromium.

According to the configuration 3, the trivalent chromate layer is provided on the nickel layer. Thus, it is possible to further improve corrosion resistance.

Configuration 4: configuration 4 is the spark plug according to any one of the configurations 1 to 3, wherein the metal shell includes an antirust oil layer containing at least one kind of carbon, barium, calcium, sodium, and sulfur.

According to the configuration 4, the metal shell includes an antirust oil layer containing at least one kind of C, Ba and the like. Therefore, it is possible to further improve corrosion resistance.

Configuration 5: configuration 5 is the spark plug according to any one of the configurations 1 to 4, wherein when a distance along the axis from the tip end of the metal shell to the seat portion is L, an anti-seizing agent is applied to 80% or more of an outer peripheral surface region between the tip end of the metal shell and a location L/3 apart from the tip end along the axis, and the anti-seizing agent contains a medium including an organic hydrocarbon component, carbon, and at least one kind of nickel, aluminum, zinc, and copper.

According to the configuration 5, an anti-seizing agent is applied to 80% or more of the outer peripheral surface region between the tip end of the metal shell and a location L/3 apart from the tip end along the axis (namely, the region on which fuel tends to accumulate and in which corrosion is particularly feared). The anti-seizing agent contains carbon (C), and carbon is first oxidized, which tends to be oxidized more than a metal forming the metal shell main body. That is, carbon (C) functions as an oxygen getter (i.e., readily absorbs oxygen). Therefore, contacting oxygen with the surface of the metal shell main body can be effectively suppressed. Consequently, it is possible to further improve corrosion resistance.

Moreover, the anti-seizing agent contains Ni or the like of a relatively high melting point. Thus, the heat resistance of the anti-seizing agent can be improved. Consequently, it is possible to more reliably prevent or suppress the volatilization of the anti-seizing agent in operating the internal combustion engine or the like. Moreover, Ni, Al, or the like contained in the anti-seizing agent forms a passivation film. Therefore, it is possible to further improve corrosion resistance.

Configuration 6: configuration 6 is the spark plug according to any one of the configurations 1 to 5, wherein the number of pin holes per unit surface area in the nickel layer is 60 points/$cm^2$ or less.

Furthermore, "the number of pin holes per unit surface area in the nickel layer" means the number of spots per 1 $cm^2$, which is measured based on the ferroxyl test stipulated in JIS H8617. More specifically, a predetermined test paper sheet immersed in a predetermined test liquid is attached to the flat portion (the nickel layer) of the tool engagement portion of the metal shell. After five minutes elapse, the test paper sheet is removed. The test paper sheet is then washed with water. After washing, the moisture of the test paper sheet is absorbed. The number of blue spots per 1 $cm^2$ on the test paper sheet is calculated. One point is given to each spot with a diameter less than 1 mm. Three points are given to each spot with a diameter of 1 mm or more and less than 3 mm. Ten points are given to each spot with a diameter of 3 mm or more and less than 5 mm. The number of the obtained points is divided by the area ($cm^2$) of the portion of the test paper sheet attached to the flat portion. Thus, the number of spots per 1 $cm^2$ can be calculated. For example, suppose that the number of spots with a diameter less than 1 mm is a, the number of spots with a diameter of 1 mm or more and less than 3 mm is b, and the area of the portion of the test paper sheet attached to the flat portion is S ($cm^2$). In this case, the number of pin holes per unit surface area in the nickel layer is $(a\times1+b\times3)/S$ (points/$cm^2$).

According to the configuration 6, the number of pin holes per unit surface area in the nickel layer is 60 points/$cm^2$ or less. Therefore, contacting acid with the surface of the metal shell main body and contacting oxygen, which is the factor of corrosion with acid, with the surface of the metal shell main body can be more reliably suppressed. Consequently, it is possible to further improve corrosion resistance.

Figure 1B:
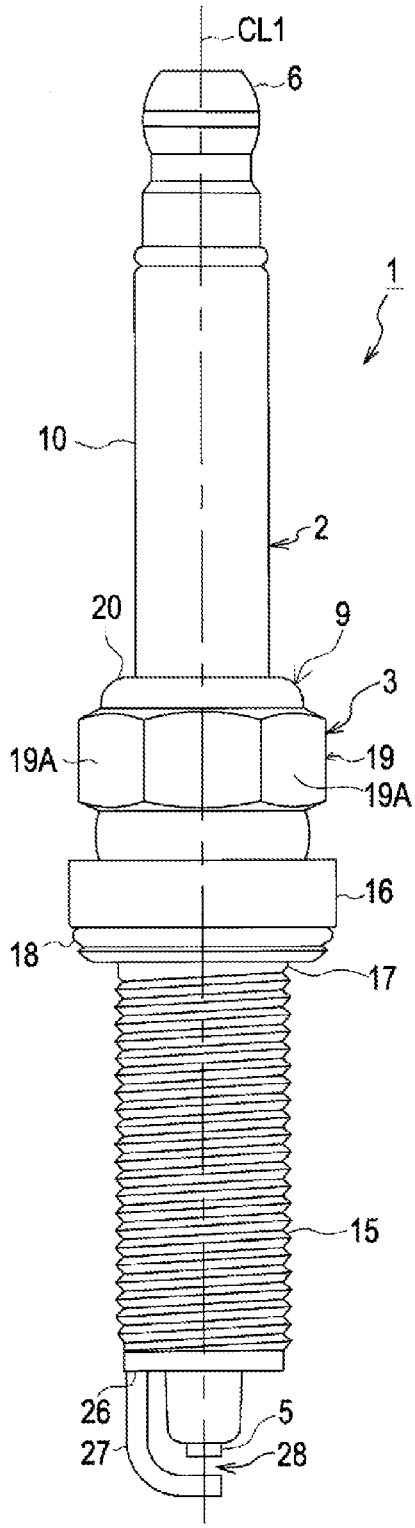
FIG. 1B is a front view of the configuration of the spark plug.

In the following, an embodiment will be described with reference to the drawings. FIG. 1A is a partial sectional front view of a spark plug 1. FIG. 1B is a front view of the spark plug 1. Note that in the description of FIGS. 1A and 1B, a direction in which an axis CL1 of the spark plug 1 extends is a vertical direction in the drawing. Moreover, the lower side is the tip end side of the spark plug 1, and the upper side is the rear end side.

The spark plug 1 is mounted on the mounting hole of a combustion apparatus (e.g., an internal combustion engine and a fuel battery reformer). As depicted in FIGS. 1A and 1B, the spark plug 1 includes a tubular insulator 2, a tubular metal shell 3 that holds the insulator 2, a center electrode 5, a terminal electrode 6, a cylindrical resistor 7, and conductive glass seal layers 8A and 8B.

The insulator 2 is formed, for example, by sintering alumina. As depicted in FIG. 1A, the insulator 2 includes a rear trunk portion 10, a large-diameter portion 11, an intermediate trunk portion 12, and a leg portion 13. These components are arranged from the rear end side to the tip end side of the insulator 2 in this order.

The large-diameter portion 11 protrudes externally in the radial direction. The intermediate trunk portion 12 has a diameter smaller than that of the large-diameter portion 11. The leg portion 13 has a diameter smaller than that of the intermediate trunk portion 12. The large-diameter portion 11, the intermediate trunk portion 12, and a large part of the leg portion 13 are accommodated in the metal shell 3. A tapered step portion 14 is formed on the joining portion between the intermediate trunk portion 12 and the leg portion 13. The step portion 14 latches the insulator 2 in the metal shell 3.

Moreover, an axial hole 4 is formed through the insulator 2 along the axis CL1. The center electrode 5 is inserted into and fixed to the tip end side of the axial hole 4. The center electrode 5 has an inner layer 5A including copper, a copper alloy, or the like excellent in thermal conductivity and an outer layer 5B including an alloy having nickel (Ni) as a principal component. Furthermore, the center electrode 5 has a rod shape (a cylindrical shape) as a whole. The tip end surface of the center electrode 5 is formed flat. The end portion of the center electrode 5 protrudes from the tip end of the insulator 2.

The terminal electrode 6 is inserted into and fixed to the rear end side of the axial hole 4. The end portion of the terminal electrode 6 protrudes from the rear end of the insulator 2.

The cylindrical resistor 7 is disposed between the center electrode 5 and the terminal electrode 6 in the axial hole 4. The end portion of the resistor 7 on the tip end side is electrically connected to the center electrode 5 through the conductive glass seal layer 8B. In addition, the end portion of the resistor 7 on the rear end side is electrically connected to the terminal electrode 6 through the conductive glass seal layer 8A.

The metal shell 3 includes a metal shell main body 9, a nickel layer 31 (see FIG. 2), an externally threaded portion 15, a seat portion 16, a screw neck 17, a tool engagement portion 19, and a crimping portion 20.

The nickel layer 31 (see FIG. 2, not depicted in FIG. 1) is provided on the outer surface of the metal shell main body 9. The nickel layer 31 will be described later. The metal shell main body 9 is formed from a metal such as low-carbon steel. The metal shell main body 9 has a tubular shape extending in the direction of the axis CL1.

The externally threaded portion 15 is formed on the outer periphery on the tip end side of the metal shell 3. The externally threaded portion 15 is an external thread to mount the spark plug 1 on the mounting hole of a combustion apparatus. The seat portion 16 is formed on the outer peripheral surface on the rear end side of the externally threaded portion 15 in such a way that the seat portion 16 protrudes radially outward. The seat portion 16 includes the nickel layer 31, a trivalent chromate layer 32, and an antirust oil layer 33, described later, on the surface thereof. The screw neck 17 is provided on the rear end of the externally threaded portion 15. The ring-shaped gasket 18 is fit into the screw neck 17.

The tool engagement portion 19 is provided on the rear end side of the seat portion 16. The cross section of the tool engagement portion 19 orthogonal to the axis CL1 has a polygonal shape (in the embodiment, a hexagonal shape). The tool engagement portion 19 is a portion with which a tool such as a wrench is engaged when mounting the spark plug 1 (the metal shell 3) on the combustion apparatus. The tool engagement portion 19 includes a plurality of flat portions 19A (in the embodiment, six flat portions 19A) to engage with a tool. The crimping portion 20 is provided on the rear end side of the tool engagement portion 19. The crimping portion 20 holds the insulator 2. The crimping portion 20 is bent radially inward.

A tapered step portion 21 is provided on the inner peripheral surface of the metal shell 3 for retaining the insulator 2. The insulator 2 is inserted into the metal shell 3 from the rear end side to the tip end side of the metal shell 3. When fixing the insulator 2 to the metal shell 3, an opening on the rear end side of the metal shell 3 is crimped radially inward in a state where the step portion 14 of the insulator 2 is latched on the step portion 21 of the metal shell 3. In other words, the crimping portion 20 is formed. Note that an annular sheet packing 22 is provided between the step portion 14 and the step portion 21 for maintaining airtightness in the combustion chamber. That is, the leg portion 13 of the insulator 2 and the metal shell 3 are partially inserted into the combustion chamber, so that a fuel gas enters the gap between the leg portion 13 and the inner peripheral surface of the metal shell 3. The sheet packing 22 prevents or suppresses the external leakage of the fuel gas.

Moreover, in order to improve the degree of sealing of the crimping portion 20, annular ring members 23 and 24 are provided between the metal shell 3 and the insulator 2 on the rear end side of the metal shell 3. Powder talc 25 is filled between the ring member 23 and the ring member 24. That is, the metal shell 3 holds the insulator 2 through the sheet packing 22, the ring members 23 and 24, and the talc 25.

The ground electrode 27 is joined to a tip end portion 26 of the metal shell 3 (the metal shell main body 9). The middle portion of the ground electrode 27 is bent. The side surface of the tip end portion of the ground electrode 27 faces the tip end portion of the center electrode 5. The ground electrode 27 includes an outer layer 27A and an inner layer 27B. The outer layer 27A includes, for example, a Ni alloy such as Inconel 600 or Inconel 601 (registered trademark). The inner layer 27B includes a copper alloy, pure copper, or the like, which is a metal with better thermal conductivity than the Ni alloy.

A spark discharge gap 28 is provided between the tip end portion of the center electrode 5 and the tip end portion of the ground electrode 27. Sparks are discharged at the spark discharge gap 28 in the direction almost along the axis CL1.

Figure 2:
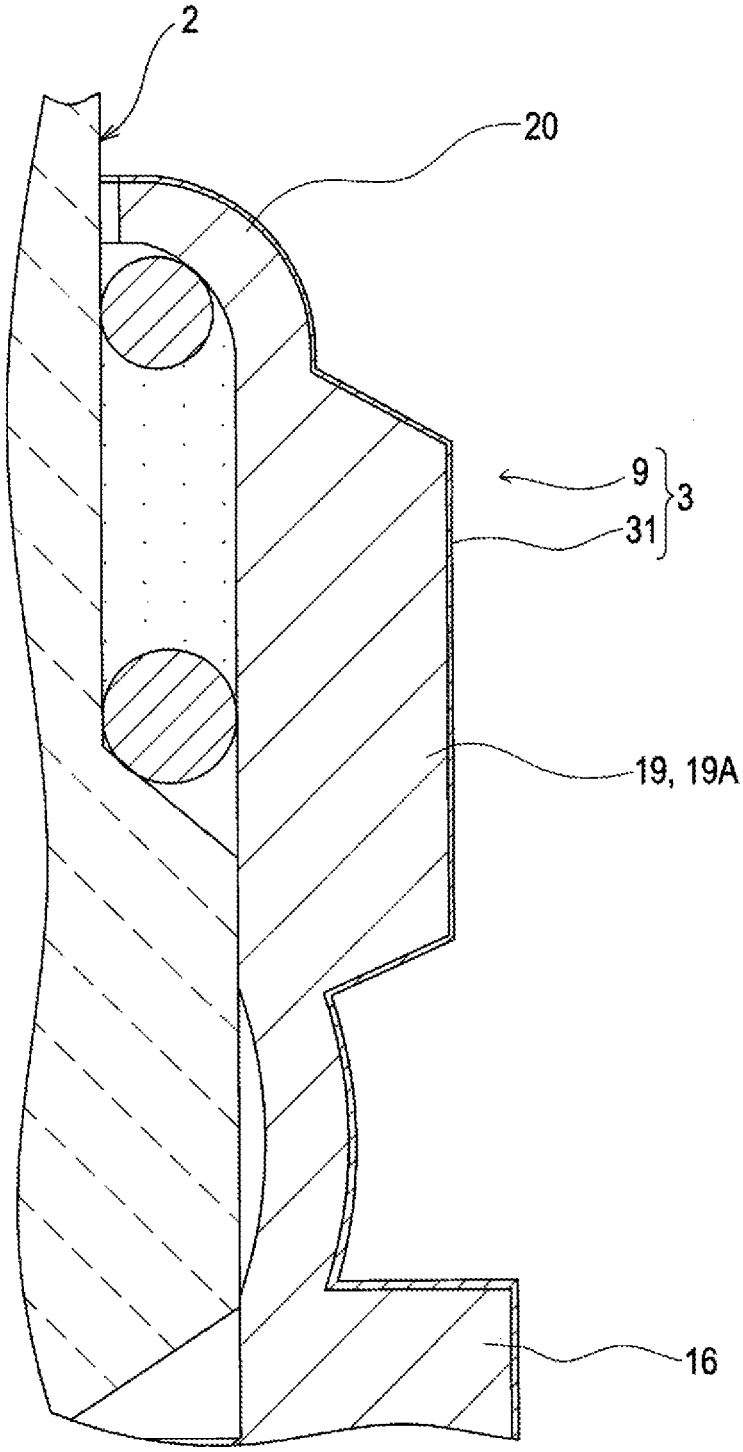
FIG. 2 is a partially enlarged cross-sectional view of a nickel layer and the like provided on the surface of the metal shell.

As depicted in FIG. 2, the nickel layer 31 containing Ni as a principal component is provided on the surface of the metal shell main body 9 (note that in FIG. 2, the thickness of the nickel layer 31 is depicted thicker than the actual thickness for convenience of illustration). The nickel layer 31 has a predetermined thickness (e.g., 5 μm or more and 15 μm or less). The nickel layer 31 is formed on almost the entire outer surface of the metal shell main body 9.

Figure 3:
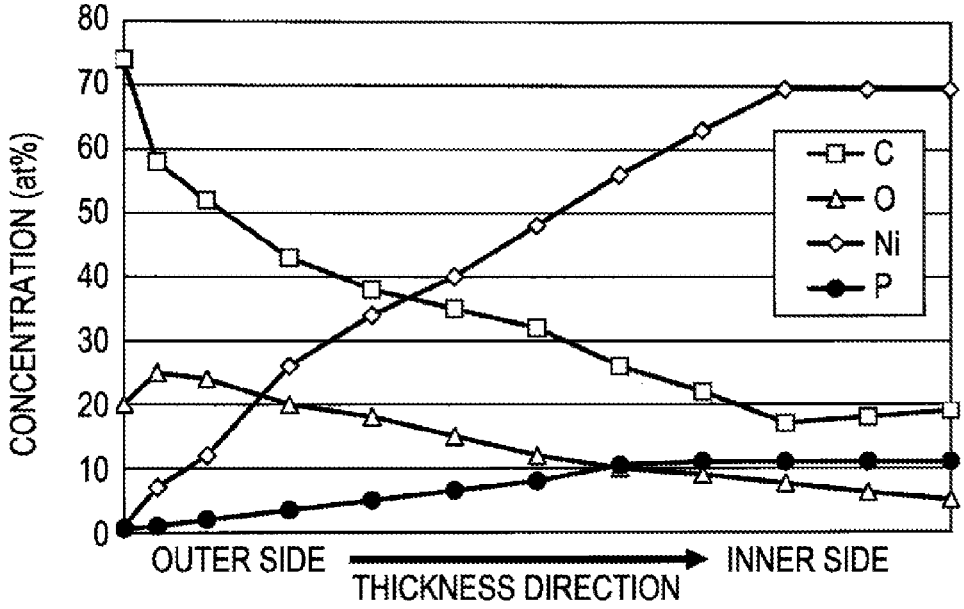
FIG. 3 is a graph of changes in the concentrations of oxygen, phosphorus, and the like in the thickness direction of the nickel layer.

In the embodiment, the nickel layer 31 contains phosphorus (P). Moreover, the concentration of P in the portion in which the concentration of Ni is 50 at % in the thickness direction of the nickel layer 31 is 6 at % or more and 20 at % or less (more preferably, 8 at % or more and 15 at % or less). That is, as depicted in FIG. 3, since impurities such as oxygen (O) and carbon (C) exist on the side close to the surface of the nickel layer 31 (on the surface side), the concentration ratio of Ni is made relatively smaller. On the other hand, there are fewer impurities on the side far from the surface of the nickel layer 31 (on the side close to the metal shell main body 9), i.e., the inner surface side. Thus, there is a portion in which the concentration of Ni is 50 at % (a first portion) on the inner surface side (the deep side) of the nickel layer 31. In the nickel layer 31, the concentration of P in the first portion is 6 at % or more and 20 at % or less. Note that the concentration of P in the portion (a second portion) of the nickel layer 31, in which the concentration of Ni is higher than 50 at %, is greater than the concentration of P in the first portion. Therefore, the fact that the concentration of P in the first portion of the nickel layer 31 is 6 at % or more means that the concentration of P in the second portion of the nickel layer 31 exceeds 6 at %, that is the nickel layer 31 contains a relatively large amount of P.

Moreover, in the embodiment, the number of pin holes per unit surface area in the nickel layer 31 is 60 points/$cm^2$ or less. Here, "the number of pin holes per unit surface area in the nickel layer 31" means the number of spots per 1 $cm^2$, which is measured based on the ferroxyl test stipulated in HS H8617. The number of pin holes per unit surface area in the nickel layer 31 can be easily measured by measuring a portion located on the surface of the flat portion 19A of the tool engagement portion 19 on the nickel layer 31. Note that in measuring the number of pin holes of the nickel layer 31, a portion located on the tip end surface of the metal shell 3 of the nickel layer 31 may be measured. Furthermore, in the embodiment, the number of pin holes per unit surface area is 60 points/$cm^2$ or less throughout the surface of the nickel layer 31. In addition to this, the number of pin holes can be changed by adjusting the temperature or pH of a plating aqueous solution for use in forming the nickel layer 31.

Figure 4:
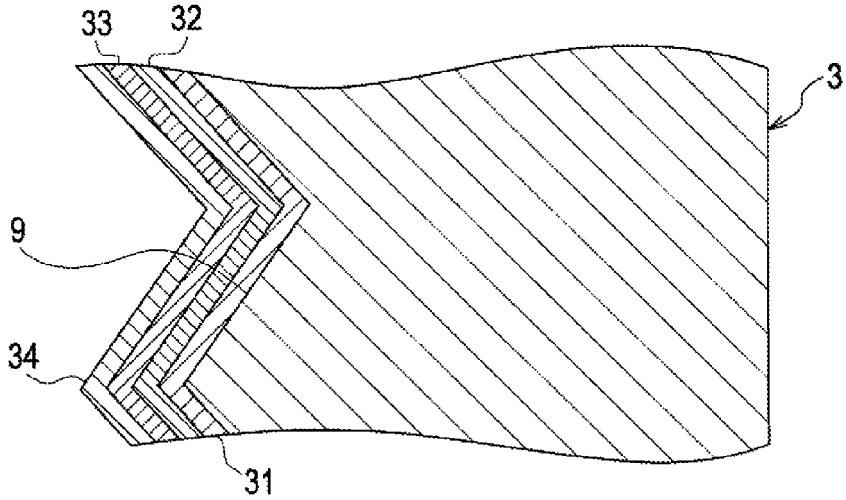

In addition to this, as depicted in FIG. 4, the metal shell 3 includes the trivalent chromate layer 32 provided on the nickel layer 31 and the antirust oil layer 33 provided on the trivalent chromate layer 32. Note that also in FIG. 4, the thicknesses of the nickel layer 31, the trivalent chromate layer 32, and the antirust oil layer 33 are depicted thicker than the actual thicknesses for convenience of illustration. Moreover, in FIG. 2, the trivalent chromate layer 32 and the antirust oil layer 33 are omitted.

The trivalent chromate layer 32 includes a chromium component. 95 mass % or more of the chromium component is trivalent chromium. Furthermore, the antirust oil layer 33 is provided on the trivalent chromate layer 32 by applying an antirust oil. The antirust oil contains at least one kind of carbon (C), barium (Ba), calcium (Ca), sodium (Na), and sulfur (S). Note that only one of the trivalent chromate layer 32 and the antirust oil layer 33 may be provided. In addition, none of the trivalent chromate layer 32 and the antirust oil layer 33 may be provided.

Figure 5:
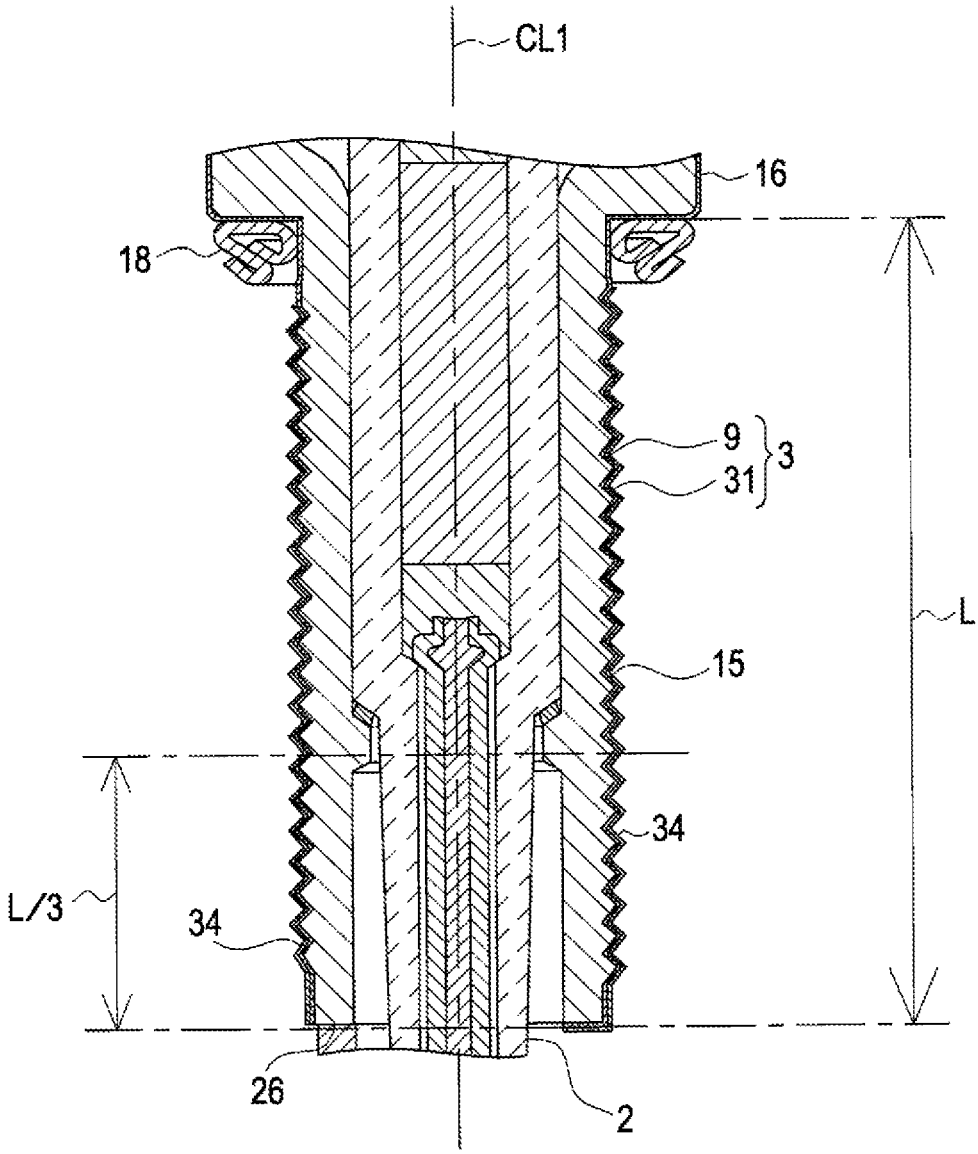

Moreover, as depicted in FIG. 5, suppose that the distance from the tip end of the metal shell 3 to the seat portion 16 along the axis CL1 is L. An anti-seizing agent 34 is applied to 80% or more of the outer peripheral surface region between the tip end of the metal shell 3 and a location L/3 apart from the tip end along the axis CL1 (in the embodiment, the entire region from the tip end of the metal shell 3 to the rear end of the externally threaded portion 15). Note that in FIG. 5, the trivalent chromate layer 32 and the antirust oil layer 33 are not depicted for convenience of illustration. Furthermore, the thicknesses of the nickel layer 31 and the anti-seizing agent 34 are depicted thicker than the actual thicknesses. The anti-seizing agent 34 contains a medium including an organic hydrocarbon component, carbon (C), and at least one kind of Ni, aluminum (Al), zinc (Zn), and copper (Cu).

Next, a method for manufacturing the spark plug 1 having the configuration described above will be described. First, the metal shell main body 9 is fabricated in advance. That is, a cylindrical metal material (an iron material such as S17C and S25C, or a stainless steel material, for example) is subjected to cold forging or the like, so that a form having the through hole of the metal shell main body 9 is fabricated. After that, the outer shape of the form is shaped by cutting, so that a metal shell intermediate body is obtained.

Subsequently, the ground electrode 27 in a straight rod shape including an Ni alloy or the like is joined to the tip end surface of the metal shell intermediate body by resistance welding. In this welding, a so-called "droop" is generated, and the "droop" is removed. After removing the droop, the externally threaded portion 15 is formed on a predetermined portion of the metal shell intermediate body by rolling. Thus, the metal shell main body 9 welded with the ground electrode 27 is obtained.

Moreover, the metal shell main body 9 welded with the ground electrode 27 is plated, so that the nickel layer 31 is formed on the outer surface of the metal shell main body 9 or the like. In the plating, an acidic plating aqueous solution (the pH is about 4.5±0.5) including sulfuric acid nickel ($NiSO_4$), sodium hypophosphite ($NaH_2PO_2$), lactic acid ($CH_3CH(OH)COOH$), propionic acid ($CH_3CH_2COOH$), and lead (Pb) is used. The temperature of the plating aqueous solution is set at a predetermined temperature (in the embodiment, 90° C.±5° C.). The metal shell main body 9 is immersed in the plating aqueous solution for a predetermined short time (in the embodiment, about 15 minutes) without passing a current (in an electroless manner). Thus, the nickel layer 31 is formed on the entire surface of the metal shell main body 9. Consequently, the metal shell 3 including the nickel layer 31 is obtained.

Furthermore, a predetermined barrel plating device in which a plating aqueous solution including sodium dichromate ($Na_2Cr_2O_7$) is stored is used to plate the metal shell 3 for a predetermined time period at a predetermined electric current density. Thus, the trivalent chromate layer 32 is formed on the nickel layer 31 of the metal shell 3.

In addition, the insulator 2 is molded separately from the metal shell 3. For example, a base agglomerated material for molding is prepared from raw material powder including a binder or the like having alumina as a main component. A tubular compact is obtained by rubber press molding using the base agglomerated material. The obtained compact is shaped by grinding. Moreover, the shaped compact is fired in a calcining furnace. Thus, the insulator 2 is obtained.

Furthermore, the center electrode 5 is fabricated separately from the metal shell 3 and the insulator 2. That is, the center electrode 5 is prepared by forging an Ni alloy having a copper alloy or the like at the center part for improving heat dissipation.

The center electrode 5, the terminal electrode 6, and the resistor 7 are then sealed and fixed to the insulator 2 thus obtained with the glass seal layers 8A and 8B. The glass seal layers 8A and 8B are obtained generally by mixing and preparing borosilicate glass and metal powder. The obtained glass seal layers 8A and 8B are filled in the axial hole 4 of the insulator 2 so as to sandwich the resistor 7. After that, the insulator 2 is heated in the calcining furnace while pressing the glass seal layer 8A with the terminal electrode 6 from the rear end side. Thus, the center electrode 5 and the like are sealed and fixed to the insulator 2. Note that a glaze layer may be formed on the surface of the rear trunk portion 10 of the insulator 2 at the same time or in advance.

After that, the insulator 2 is inserted into the metal shell 3 from the opening on the rear end side. Moreover, the rear end portion of the metal shell 3 is pressed in the direction of the axis CL1, so that the rear end portion is bent radially inward (namely, the crimping portion 20 is formed). Thus, the insulator 2 is fixed to the metal shell 3.

Subsequently, the ground electrode 27 is bent to the center electrode 5 side. After that, the size of the spark discharge gap 28 formed between the center electrode 5 and the ground electrode 27 is adjusted.

The metal shell 3 (at least the externally threaded portion 15) is then immersed in an antirust oil including C, Ba, and the like for a predetermined time period (e.g., for ten minutes,). After immersion, the metal shell 3 is allowed to stand for a predetermined time period (e.g., 15 minutes). Subsequently, the metal shell 3 is centrifugally dried for a predetermined time period (e.g., five minutes) at a predetermined number of revolutions (e.g., 600 rpm). Thus, the antirust oil layer 33 is provided on the metal shell 3. Lastly, the anti-seizing agent 34 containing carbon (C) and the like and having a medium of an organic hydrocarbon component is applied to at least the tip end portion of the metal shell 3. Accordingly, the above-described spark plug 1 is obtained.

As described in detail above, according to the embodiment, the nickel layer 31 contains P. In the nickel layer 31, the concentration of P is 6 at % or more in the portion where the concentration of Ni is 50 at % (the first portion) in the thickness direction thereof. Thus, the existence of P can effectively suppress the grain growth of crystal grains in forming the nickel layer 31. Therefore, the grain size of crystal grains forming the nickel layer 31 can be sufficiently made smaller. Consequently, it is possible to improve corrosion resistance.

On the other hand, the concentration of P in the nickel layer 31 in the first portion is 20 at % or less. Thus, the occurrence of corrosion starting from P can be more reliably suppressed. Consequently, it is possible to more reliably exert the effect of improving corrosion resistance.

Moreover, according to the embodiment, the existence of P can effectively suppress the grain growth of crystal grains. Thus, it is unnecessary to prolong immersion time in order to decrease the grain size of crystal grains, for example. Therefore, immersion time can be shortened. Consequently, it is possible to dramatically improve productivity.

Furthermore, in the embodiment, the nickel layer 31 is formed in an electroless manner. Thus, the thicknesses of the respective portions of the nickel layer 31 can be made relatively uniform. Therefore, a situation where a slight portion of the nickel layer 31 is partially thin can be more reliably prevented or suppressed. Consequently, it is possible to more reliably prevent or suppress a situation where the corrosion resistance of a part of the metal shell 3 is insufficient.

In addition to this, in the embodiment, both of the trivalent chromate layer 32 and the antirust oil layer 33 are provided on the metal shell 3. Thus, it is possible to more effectively improve the corrosion resistance of the metal shell 3.

Moreover, the anti-seizing agent 34 containing carbon (C) is applied to 80% or more of the surface region between the tip end of the metal shell 3 and a location L/3 apart from the tip end along the axis CL1 (namely, a region on which fuel tends to accumulate and in which corrosion is particularly feared). Thus, carbon (C) is first oxidized, which tends to be oxidized more than a metal forming the metal shell main body 9. That is, carbon (C) functions as an oxygen getter, so that contacting oxygen with the surface of the metal shell main body 9 can be effectively suppressed. Consequently, it is possible to further improve corrosion resistance.

Furthermore, in the embodiment, the anti-seizing agent 34 contains Ni and the like of a relatively high melting point. Thus, the heat resistance of the anti-seizing agent 34 can be improved. Consequently, the volatilization of the anti-seizing agent 34 can be more reliably prevented or suppressed in operating the internal combustion engine or the like. In addition, Ni, Al, and the like contained in the anti-seizing agent 34 form a passivation film. Thus, it is possible to further improve corrosion resistance.

Moreover, in the embodiment, the number of pin holes per unit surface area in the nickel layer 31 is 60 points/$cm^2$ or less. Therefore, contacting acid and oxygen with the surface of the metal shell main body 9 can be more reliably suppressed. Consequently, it is possible to further improve corrosion resistance.

Next, in order to confirm the operation and effect exerted by the embodiment, a plurality of metal shell samples was prepared, and corrosion resistance evaluation tests were performed on the samples based on a test method stipulated in JIS H8502. In the samples, the number of pin holes per unit surface area and the concentration of P (at %) in the portion in which the concentration of Ni is 50 at % (the first portion) in the thickness direction of the nickel layer are variously changed. Moreover, in the samples, the presence or absence of the trivalent chromate layer, the antirust oil layer, and the anti-seizing agent is changed.

The outline of the corrosion resistance evaluation tests is as follows. That is, the samples were allowed to stand for six hours or 12 hours in an atmosphere in which a predetermined etchant (the sodium chloride concentration was 50 g/L±5 g/L and the pH was adjusted to 3.0 with acetic acid) was sprayed. After that, images of metal shells were taken with a predetermined camera. Subsequently, the taken images were analyzed to confirm the presence or absence of red rust on the surface of the metal shell. In the case where red rust was generated, the ratio of the area of portions where red rust was generated to the surface area of the metal shell (a red rust ratio) was calculated based on the taken image. Here, an evaluation mark "star (☆)" was given to a sample on which the generation of red rust was not confirmed because of an extremely excellent corrosion resistance. An evaluation mark "double circle (⊙)" was given to a sample whose red rust ratio was as sufficiently small as 5% or less because of an excellent corrosion resistance although red rust was generated. An evaluation mark "circle (○)" was given to a sample whose red rust ratio was more than 5% and 10% or less because of a sufficient corrosion resistance. On the other hand, an evaluation mark "cross (X)" was given to a sample whose red rust ratio was more than 10% because of an inferior corrosion resistance. Table 1 shows the test results of samples in which the concentration of P in the first portion was 5 at %. Table 2 shows the test results of samples in which the concentration of P in the first portion was 6 at %. Table 3 shows the test results of samples in which the concentration of P in the first portion was 8 at %. Table 4 shows the test results of samples in which the concentration of P in the first portion was 10 at %. Table 5 shows the test results of samples in which the concentration of P in the first portion was 15 at %. Table 6 shows the test results of samples in which the concentration of P in the first portion was 20 at %. Table 7 shows the test results of samples in which the concentration of P in the first portion was 30 at %.

A plating aqueous solution for use includes 20 g/L of sulfuric acid nickel, 25 g/L of lactic acid, 3 g/L of propionic acid, and 1 g/L of lead. Immersion time for the samples in the plating aqueous solution is 15 minutes. Furthermore, the concentration of P in the first portion of the samples was changed by varying the content of sodium hypophosphite in the plating aqueous solution. Moreover, the number of pin holes per unit surface area in the nickel layer was changed by varying the temperature and pH of the plating aqueous solution. Furthermore, the pH of the plating aqueous solution was changed by putting sulfuric acid or sodium carbonate in the plating aqueous solution. Tables show the content of sodium hypophosphite and the temperature and pH of the plating aqueous solution for reference.

TABLE 1

| | Ni PLATING CONDITIONS | SODIUM HYPOPHOSPHITE (g/L) | | | | 20 | | | | |
|---|---|---|---|---|---|---|---|---|---|---|
| | | P CONCENTRATION IN FIRST PORTION (at %) | | | | 5 | | | | |
| | Ni PLATING CONDITIONS | TEMPERATURE (° C.) | | 85 | | | 90 | | | 95 |
| | | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | | 7 | 36 | 63 | 16 | 42 | 63 | 32 | 48 | 64 |
| 6 h | ONLY NICKEL LAYER (Ni LAYER) | | X | X | X | X | X | X | X | X | X |
| | Ni LAYER + TRIVALENT CHROMATE LAYER | | X | X | X | X | X | X | X | X | X |
| | Ni LAYER + ANTIRUST OIL LAYER | | X | X | X | X | X | X | X | X | X |
| | Ni LAYER + TRIVALENT CHROMATE LAYER + ANTIRUST OIL LAYER | | X | X | X | X | X | X | X | X | X |
| | Ni LAYER + ANTI-SEIZING AGENT | | X | X | X | X | X | X | X | X | X |
| | Ni LAYER + TRIVALENT CHROMATE LAYER + ANTI-SEIZING AGENT | | X | X | X | X | X | X | X | X | X |
| | Ni LAYER + ANTIRUST OIL LAYER + ANTI-SEIZING AGENT | | X | X | X | X | X | X | X | X | X |
| | Ni LAYER + TRIVALENT CHROMATE LAYER + ANTIRUST OIL LAYER + ANTI-SEIZING AGENT | | X | X | X | X | X | X | X | X | X |
| 12 h | ONLY NICKEL LAYER | | X | X | X | X | X | X | X | X | X |
| | Ni LAYER + TRIVALENT CHROMATE LAYER | | X | X | X | X | X | X | X | X | X |
| | Ni LAYER + ANTIRUST OIL LAYER | | X | X | X | X | X | X | X | X | X |
| | Ni LAYER + TRIVALENT CHROMATE LAYER + ANTIRUST OIL LAYER | | X | X | X | X | X | X | X | X | X |
| | Ni LAYER + ANTI-SEIZING AGENT | | X | X | X | X | X | X | X | X | X |
| | Ni LAYER + TRIVALENT CHROMATE LAYER + ANTI-SEIZING AGENT | | X | X | X | X | X | X | X | X | X |
| | Ni LAYER + ANTIRUST OIL LAYER + ANTI-SEIZING AGENT | | X | X | X | X | X | X | X | X | X |
| | Ni LAYER + TRIVALENT CHROMATE LAYER + ANTIRUST OIL LAYER + ANTI-SEIZING AGENT | | X | X | X | X | X | X | X | X | X |

TABLE 2

| | Ni PLATING CONDITIONS | SODIUM HYPOPHOSPHITE (g/L) | | | | 25 | | | | |
|---|---|---|---|---|---|---|---|---|---|---|
| | | P CONCENTRATION IN FIRST PORTION (at %) | | | | 6 | | | | |
| | Ni PLATING CONDITIONS | TEMPERATURE (° C.) | | 85 | | | 90 | | | 95 |
| | | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | | 5 | 34 | 61 | 14 | 40 | 61 | 30 | 46 | 62 |
| 6 h | ONLY NICKEL LAYER (Ni LAYER) | | ○ | ○ | ○ | ○ | ○ | ○ | ○ | ○ | ○ |
| | Ni LAYER + TRIVALENT CHROMATE LAYER | | ○ | ○ | ○ | ○ | ○ | ○ | ○ | ○ | ○ |
| | Ni LAYER + ANTIRUST OIL LAYER | | ○ | ○ | ○ | ○ | ○ | ○ | ○ | ○ | ○ |
| | Ni LAYER + TRIVALENT CHROMATE LAYER + ANTIRUST OIL LAYER | | ⊙ | ⊙ | ⊙ | ⊙ | ⊙ | ⊙ | ⊙ | ⊙ | ⊙ |
| | Ni LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | | ⊙ | ⊙ | ⊙ | ⊙ | ⊙ | ⊙ | ⊙ | ⊙ | ⊙ |
| | Ni LAYER + ANTIRUST OIL LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER + ANTI-SEIZING AGENT | | ☆ | ☆ | ☆ | ☆ | ☆ | ☆ | ☆ | ☆ | ☆ |
| 12 h | ONLY NICKEL LAYER | | ○ | ○ | X | ○ | ○ | X | ○ | ○ | X |
| | Ni LAYER + TRIVALENT CHROMATE LAYER | | ○ | ○ | X | ○ | ○ | X | ○ | ○ | X |
| | Ni LAYER + ANTIRUST OIL LAYER | | ○ | ○ | X | ○ | ○ | X | ○ | ○ | X |
| | Ni LAYER + TRIVALENT CHROMATE LAYER + ANTIRUST OIL LAYER | | ⊙ | ⊙ | X | ⊙ | ⊙ | X | ⊙ | ⊙ | X |
| | Ni LAYER + ANTI-SEIZING AGENT | | ⊙ | ⊙ | X | ⊙ | ⊙ | X | ⊙ | ⊙ | X |
| | Ni LAYER + TRIVALENT CHROMATE LAYER + ANTI-SEIZING AGENT | | ⊙ | ⊙ | X | ⊙ | ⊙ | X | ⊙ | ⊙ | X |

TABLE 2-continued

| | | | | | | | | | |
|---|---|---|---|---|---|---|---|---|---|
| Ni LAYER + ANTIRUST OIL LAYER + ANTI-SEIZING AGENT | ⊙ | ⊙ | X | ⊙ | ⊙ | X | ⊙ | ⊙ | X |
| Ni LAYER + TRIVALENT CHROMATE LAYER + ANTIRUST OIL LAYER + ANTI-SEIZING AGENT | ☆ | ☆ | X | ☆ | ☆ | X | ☆ | ☆ | X |

TABLE 3

| | | | | | | | | | | |
|---|---|---|---|---|---|---|---|---|---|---|
| | Ni PLATING CONDITIONS | SODIUM HYPOPHOSPHITE (g/L) | | | | 30 | | | | |
| | P CONCENTRATION IN FIRST PORTION (at %) | | | | | 8 | | | | |
| | Ni PLATING CONDITIONS | TEMPERATURE (° C.) | | 85 | | | 90 | | | 95 |
| | | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | | 3 | 32 | 59 | 12 | 38 | 59 | 28 | 44 | 60 |
| 6 h | ONLY NICKEL LAYER (Ni LAYER) | | ○ | ○ | ○ | ○ | ○ | ○ | ○ | ○ | ○ |
| | Ni LAYER + TRIVALENT CHROMATE LAYER | | ⊙ | ⊙ | ⊙ | ⊙ | ⊙ | ⊙ | ⊙ | ⊙ | ⊙ |
| | Ni LAYER + ANTIRUST OIL LAYER | | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER | | ☆ | ☆ | ☆ | ☆ | ☆ | ☆ | ☆ | ☆ | ☆ |
| | Ni LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | | ☆ | ☆ | ☆ | ☆ | ☆ | ☆ | ☆ | ☆ | ☆ |
| | Ni LAYER + ANTIRUST OIL LAYER + ANTI-SEIZING AGENT | | ☆ | ☆ | ☆ | ☆ | ☆ | ☆ | ☆ | ☆ | ☆ |
| | Ni LAYER + TRIVALENT CHROMATE LAYER + ANTIRUST OIL LAYER + ANTI-SEIZING AGENT | | ☆ | ☆ | ☆ | ☆ | ☆ | ☆ | ☆ | ☆ | ☆ |
| 12 h | ONLY NICKEL LAYER | | ○ | ○ | ○ | ○ | ○ | ○ | ○ | ○ | ○ |
| | Ni LAYER + TRIVALENT CHROMATE LAYER | | ⊙ | ⊙ | ⊙ | ⊙ | ⊙ | ⊙ | ⊙ | ⊙ | ⊙ |
| | Ni LAYER + ANTIRUST OIL LAYER | | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER | | ☆ | ☆ | ☆ | ☆ | ☆ | ☆ | ☆ | ☆ | ☆ |
| | Ni LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | | ☆ | ☆ | ☆ | ☆ | ☆ | ☆ | ☆ | ☆ | ☆ |
| | Ni LAYER + ANTIRUST OIL LAYER + ANTI-SEIZING AGENT | | ☆ | ☆ | ☆ | ☆ | ☆ | ☆ | ☆ | ☆ | ☆ |
| | Ni LAYER + TRIVALENT CHROMATE LAYER + ANTIRUST OIL LAYER + ANTI-SEIZING AGENT | | ☆ | ☆ | ☆ | ☆ | ☆ | ☆ | ☆ | ☆ | ☆ |

TABLE 4

| | | | | | | | | | | |
|---|---|---|---|---|---|---|---|---|---|---|
| | Ni PLATING CONDITIONS | SODIUM HYPOPHOSPHITE (g/L) | | | | 35 | | | | |
| | P CONCENTRATION IN FIRST PORTION (at %) | | | | | 10 | | | | |
| | Ni PLATING CONDITIONS | TEMPERATURE (° C.) | | 85 | | | 90 | | | 95 |
| | | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | | 3 | 32 | 59 | 12 | 38 | 59 | 28 | 44 | 60 |
| 6 h | ONLY NICKEL LAYER (Ni LAYER) | | ○ | ○ | ○ | ○ | ○ | ○ | ○ | ○ | ○ |
| | Ni LAYER + TRIVALENT CHROMATE LAYER | | ⊙ | ⊙ | ⊙ | ⊙ | ⊙ | ⊙ | ⊙ | ⊙ | ⊙ |
| | Ni LAYER + ANTIRUST OIL LAYER | | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER | | ☆ | ☆ | ☆ | ☆ | ☆ | ☆ | ☆ | ☆ | ☆ |
| | Ni LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | | ☆ | ☆ | ☆ | ☆ | ☆ | ☆ | ☆ | ☆ | ☆ |
| | Ni LAYER + ANTIRUST OIL LAYER + ANTI-SEIZING AGENT | | ☆ | ☆ | ☆ | ☆ | ☆ | ☆ | ☆ | ☆ | ☆ |
| | Ni LAYER + TRIVALENT CHROMATE LAYER + ANTIRUST OIL LAYER + ANTI-SEIZING AGENT | | ☆ | ☆ | ☆ | ☆ | ☆ | ☆ | ☆ | ☆ | ☆ |

TABLE 4-continued

| | | | | | | | | | | |
|---|---|---|---|---|---|---|---|---|---|---|
| 12 h | ONLY NICKEL LAYER | ○ | ○ | ○ | ○ | ○ | ○ | ○ | ○ | ○ |
| | Ni LAYER + TRIVALENT CHROMATE LAYER | ⊙ | ⊙ | ⊙ | ⊙ | ⊙ | ⊙ | ⊙ | ⊙ | ⊙ |
| | Ni LAYER + ANTIRUST OIL LAYER | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER | ☆ | ☆ | ☆ | ☆ | ☆ | ☆ | ☆ | ☆ | ☆ |
| | Ni LAYER + ANTI-SEIZING AGENT | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | ☆ | ☆ | ☆ | ☆ | ☆ | ☆ | ☆ | ☆ | ☆ |
| | Ni LAYER + ANTIRUST OIL LAYER + ANTI-SEIZING AGENT | ☆ | ☆ | ☆ | ☆ | ☆ | ☆ | ☆ | ☆ | ☆ |
| | Ni LAYER + TRIVALENT CHROMATE LAYER + ANTIRUST OIL LAYER + ANTI-SEIZING AGENT | ☆ | ☆ | ☆ | ☆ | ☆ | ☆ | ☆ | ☆ | ☆ |

TABLE 5

| | | | | | | | | | | |
|---|---|---|---|---|---|---|---|---|---|---|
| | Ni PLATING CONDITIONS | SODIUM HYPOPHOSPHITE (g/L) | | | | 37 | | | | |
| | P CONCENTRATION IN FIRST PORTION (at %) | | | | | 15 | | | | |
| | Ni PLATING CONDITIONS | TEMPERATURE (° C.) | | 85 | | | 90 | | | 95 |
| | | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | | 3 | 32 | 59 | 12 | 38 | 59 | 28 | 44 | 60 |
| 6 h | ONLY NICKEL LAYER (Ni LAYER) | | ○ | ○ | ○ | ○ | ○ | ○ | ○ | ○ | ○ |
| | Ni LAYER + TRIVALENT CHROMATE LAYER | | ⊙ | ⊙ | ⊙ | ⊙ | ⊙ | ⊙ | ⊙ | ⊙ | ⊙ |
| | Ni LAYER + ANTIRUST OIL LAYER | | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER | | ☆ | ☆ | ☆ | ☆ | ☆ | ☆ | ☆ | ☆ | ☆ |
| | Ni LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | | ☆ | ☆ | ☆ | ☆ | ☆ | ☆ | ☆ | ☆ | ☆ |
| | Ni LAYER + ANTIRUST OIL LAYER + ANTI-SEIZING AGENT | | ☆ | ☆ | ☆ | ☆ | ☆ | ☆ | ☆ | ☆ | ☆ |
| | Ni LAYER + TRIVALENT CHROMATE LAYER + ANTIRUST OIL LAYER + ANTI-SEIZING AGENT | | ☆ | ☆ | ☆ | ☆ | ☆ | ☆ | ☆ | ☆ | ☆ |
| 12 h | ONLY NICKEL LAYER | | ○ | ○ | ○ | ○ | ○ | ○ | ○ | ○ | ○ |
| | Ni LAYER + TRIVALENT CHROMATE LAYER | | ⊙ | ⊙ | ⊙ | ⊙ | ⊙ | ⊙ | ⊙ | ⊙ | ⊙ |
| | Ni LAYER + ANTIRUST OIL LAYER | | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER | | ☆ | ☆ | ☆ | ☆ | ☆ | ☆ | ☆ | ☆ | ☆ |
| | Ni LAYER + ANTI-SEIZING AGENT | | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | | ☆ | ☆ | ☆ | ☆ | ☆ | ☆ | ☆ | ☆ | ☆ |
| | Ni LAYER + ANTIRUST OIL LAYER + ANTI-SEIZING AGENT | | ☆ | ☆ | ☆ | ☆ | ☆ | ☆ | ☆ | ☆ | ☆ |
| | Ni LAYER + TRIVALENT CHROMATE LAYER + ANTIRUST OIL LAYER + ANTI-SEIZING AGENT | | ☆ | ☆ | ☆ | ☆ | ☆ | ☆ | ☆ | ☆ | ☆ |

TABLE 6

| | | | | | | | | | | |
|---|---|---|---|---|---|---|---|---|---|---|
| | Ni PLATING CONDITIONS | SODIUM HYPOPHOSPHITE (g/L) | | | | 40 | | | | |
| | P CONCENTRATION IN FIRST PORTION (at %) | | | | | 20 | | | | |
| | Ni PLATING CONDITIONS | TEMPERATURE (° C.) | | 85 | | | 90 | | | 95 |
| | | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | | 1 | 30 | 56 | 10 | 36 | 57 | 26 | 42 | 58 |
| 6 h | ONLY NICKEL LAYER (Ni LAYER) | | ○ | ○ | ○ | ○ | ○ | ○ | ○ | ○ | ○ |
| | Ni LAYER + TRIVALENT CHROMATE LAYER | | ○ | ○ | ○ | ○ | ○ | ○ | ○ | ○ | ○ |
| | Ni LAYER + ANTIRUST OIL LAYER | | ○ | ○ | ○ | ○ | ○ | ○ | ○ | ○ | ○ |

TABLE 6-continued

| | | | | | | | | | | |
|---|---|---|---|---|---|---|---|---|---|---|
| | Ni LAYER + TRIVALENT CHROMATE LAYER + ANTIRUST OIL LAYER | ⊙ | ⊙ | ⊙ | ⊙ | ⊙ | ⊙ | ⊙ | ⊙ | ⊙ |
| | Ni LAYER + ANTI-SEIZING AGENT | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | ⊙ | ⊙ | ⊙ | ⊙ | ⊙ | ⊙ | ⊙ | ⊙ | ⊙ |
| | Ni LAYER + ANTIRUST OIL LAYER + ANTI-SEIZING AGENT | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER + ANTI-SEIZING AGENT | ☆ | ☆ | ☆ | ☆ | ☆ | ☆ | ☆ | ☆ | ☆ |
| 12 h | ONLY NICKEL LAYER | ○ | ○ | ○ | ○ | ○ | ○ | ○ | ○ | ○ |
| | Ni LAYER + TRIVALENT CHROMATE LAYER | ○ | ○ | ○ | ○ | ○ | ○ | ○ | ○ | ○ |
| | Ni LAYER + ANTIRUST OIL LAYER | ○ | ○ | ○ | ○ | ○ | ○ | ○ | ○ | ○ |
| | Ni LAYER + TRIVALENT CHROMATE LAYER + ANTIRUST OIL LAYER | ⊙ | ⊙ | ⊙ | ⊙ | ⊙ | ⊙ | ⊙ | ⊙ | ⊙ |
| | Ni LAYER + ANTI-SEIZING AGENT | ⊙ | ⊙ | ⊙ | ⊙ | ⊙ | ⊙ | ⊙ | ⊙ | ⊙ |
| | Ni LAYER + TRIVALENT CHROMATE LAYER + ANTI-SEIZING AGENT | ⊙ | ⊙ | ⊙ | ⊙ | ⊙ | ⊙ | ⊙ | ⊙ | ⊙ |
| | Ni LAYER + ANTIRUST OIL LAYER + ANTI-SEIZING AGENT | ⊙ | ⊙ | ⊙ | ⊙ | ⊙ | ⊙ | ⊙ | ⊙ | ⊙ |
| | Ni LAYER + TRIVALENT CHROMATE LAYER + ANTIRUST OIL LAYER + ANTI-SEIZING AGENT | ☆ | ☆ | ☆ | ☆ | ☆ | ☆ | ☆ | ☆ | ☆ |

TABLE 7

| | | | | | | | | | | |
|---|---|---|---|---|---|---|---|---|---|---|
| | Ni PLATING CONDITIONS SODIUM HYPOPHOSPHITE (g/L) | | | | | 45 | | | | |
| | P CONCENTRATION IN FIRST PORTION (at %) | | | | | 30 | | | | |
| | Ni PLATING CONDITIONS TEMPERATURE (° C.) | | 85 | | | 90 | | | 95 | |
| | PH | 4.0 | 4.5 | 5.0 | 4.0 | 4.5 | 5.0 | 4.0 | 4.5 | 5.0 |
| TEST TIME | NUMBER OF PIN HOLES (POINTS/cm$^2$) | 1 | 28 | 54 | 8 | 34 | 55 | 24 | 40 | 56 |
| 6 h | ONLY NICKEL LAYER (Ni LAYER) | X | X | X | X | X | X | X | X | X |
| | Ni LAYER + TRIVALENT CHROMATE LAYER | X | X | X | X | X | X | X | X | X |
| | Ni LAYER + ANTIRUST OIL LAYER | X | X | X | X | X | X | X | X | X |
| | Ni LAYER + TRIVALENT CHROMATE LAYER + ANTIRUST OIL LAYER | X | X | X | X | X | X | X | X | X |
| | Ni LAYER + ANTI-SEIZING AGENT | X | X | X | X | X | X | X | X | X |
| | Ni LAYER + TRIVALENT CHROMATE LAYER + ANTI-SEIZING AGENT | X | X | X | X | X | X | X | X | X |
| | Ni LAYER + ANTIRUST OIL LAYER + ANTI-SEIZING AGENT | X | X | X | X | X | X | X | X | X |
| | Ni LAYER + TRIVALENT CHROMATE LAYER + ANTIRUST OIL LAYER + ANTI-SEIZING AGENT | X | X | X | X | X | X | X | X | X |
| 12 h | ONLY NICKEL LAYER | X | X | X | X | X | X | X | X | X |
| | Ni LAYER + TRIVALENT CHROMATE LAYER | X | X | X | X | X | X | X | X | X |
| | Ni LAYER + ANTIRUST OIL LAYER | X | X | X | X | X | X | X | X | X |
| | Ni LAYER + TRIVALENT CHROMATE LAYER + ANTIRUST OIL LAYER | X | X | X | X | X | X | X | X | X |
| | Ni LAYER + ANTI-SEIZING AGENT | X | X | X | X | X | X | X | X | X |
| | Ni LAYER + TRIVALENT CHROMATE LAYER + ANTI-SEIZING AGENT | X | X | X | X | X | X | X | X | X |
| | Ni LAYER + ANTIRUST OIL LAYER + ANTI-SEIZING AGENT | X | X | X | X | X | X | X | X | X |
| | Ni LAYER + TRIVALENT CHROMATE LAYER + ANTIRUST OIL LAYER + ANTI-SEIZING AGENT | X | X | X | X | X | X | X | X | X |

As shown in Table 1, it was found that the corrosion resistances of the samples in which the concentration of P in the first portion was less than 6 at % were insufficient. The reason can be considered as follows. That is, in these samples, the concentration of P was relatively small. Thus, it was difficult to sufficiently suppress the grain growth of crystal grains forming the nickel layer. Consequently, the crystal grains became coarse.

Moreover, as shown in Table 7, it was confirmed that the corrosion resistances of the samples in which the concentration of P in the first portion was increased more than 20 at % were also inferior. The reason can be considered as follows. That is, P is more corrosive than Ni, and in these samples, the concentration of P was excessively large. Thus, corrosion starting from P was prone to occur.

On the contrary, as apparent from Tables 2 to 6, in the case where the time to allow the samples to stand in the etchant was six hours, the samples in which the concentration of P in the first portion was 6 at % or more and 20 at % or less exhibited an excellent corrosion resistance. The reason can be considered as follows. That is, in these samples, the concentration of P in the first portion is 6 at % or more, so that the grain growth of crystal grains forming the nickel layer was effectively suppressed. Moreover, the concentration of P is 20 at % or less, so that the occurrence of corrosion starting from P was more reliably prevented or suppressed.

Particularly, as shown in Tables 3 to 5, it was found that the samples in which the concentration of P in the first portion was 8 at % or more and 15 at % or less exhibited an excellent corrosion resistance to further effectively suppress the generation of red rust.

Furthermore, it was confirmed that the provision of the trivalent chromate layer, the antirust oil layer, or the anti-seizing agent can further improve corrosion resistance. Particularly, it was found that the provision of two of the trivalent chromate layer, the antirust oil layer, and the anti-seizing agent can further improve corrosion resistance. In addition, it was found that the provision of all of the trivalent chromate layer, the antirust oil layer, and the anti-seizing agent achieves a significantly excellent corrosion resistance.

In addition to this, it was found that, when the concentration of P in the first portion is set to 6 at % or more and 20 at % or less and the number of pin holes per unit surface area in the nickel layer is 60 points/$cm^2$ or less, the generation of red rust can be sufficiently suppressed even under the severe conditions that the time to allow the samples to stand in the etchant was 12 hours. This is considered to be because contacting acid and oxygen with the surface of the metal shell main body is more reliably suppressed.

From the results of the tests, preferably, P is contained in the nickel layer, and the concentration of P in the first portion of the nickel layer is set to 6 at % or more and 20 at % or less in order to improve corrosion resistance. Moreover, in order to further improve corrosion resistance, more preferably, the concentration of P in the first portion of the nickel layer is set to 8 at % or more and 15 at % or less.

Furthermore, from the viewpoint of further improving corrosion resistance, it can be said that preferably, any one of the trivalent chromate layer, the antirust oil layer, and the anti-seizing agent is provided. More preferably, any two of the trivalent chromate layer, the antirust oil layer, and the anti-seizing agent are provided, and much more preferably, all of the trivalent chromate layer, the antirust oil layer, and the anti-seizing agent are provided.

In addition, setting the number of pin holes per unit surface area in the nickel layer to 60 points/$cm^2$ or less is more preferable from the viewpoint of further improving corrosion resistance.

Note that the spark plug according to the present disclosure is not limited to the description of the embodiment. The spark plug according to the present disclosure may be, for example, implemented as follows. Of course, other applications and alterations, not exemplified below, are also possible.

(a) Rolling or the like in forming the externally threaded portion 15 sometimes causes accumulation of an impurity such as oil on the surface of the metal shell main body 9 before providing the nickel layer 31. In consideration of this point, the metal shell main body 9 may be subjected to nickel striking before plating for providing the nickel layer 31. In this case, a thin nickel strike layer is provided on the surface of the metal shell main body 9. Nickel striking is barrel plating using a highly acidic plating aqueous solution (the pH is 1 or less) including $NiSO_4$, $NiCl_2$, $H_3BO_3$, or HCl, for example. Impurities accumulated on the surface of the metal shell main body 9 can be removed by nickel striking. Consequently, the adhesion of the nickel layer 31 to the metal shell main body 9 can be further improved. Accordingly, it is possible to further improve corrosion resistance.

(b) In the spark plug 1 according to the embodiment, sparks are discharged at the spark discharge gap 28. However, the configuration of the spark plug to which the technical idea of the present disclosure can be applied is not limited thereto. Therefore, the spark plug according to the present disclosure may be an AC plasma spark plug, for example. In the spark plug, AC power is applied to the spark discharge gap for generating AC plasma in the spark discharge gap. Moreover, the spark plug according to the present disclosure may be a plasma jet spark plug. In this spark plug, a cavity (a space) is provided at the tip end portion of the insulator. Plasma is generated in and discharged from the cavity.

(c) In the embodiment, the ground electrode 27 is joined to the tip end portion of the metal shell main body 9. Regarding this point, the ground electrode may be formed by cutting a part of the metal shell main body (or a part of a metal tip end welded to the metal shell main body in advance) (JP-A-2006-236906, for example).

(d) In the embodiment, the cross section of the tool engagement portion 19 is in a hexagonal shape. However, the shape of the tool engagement portion 19 is not limited to this shape. For example, the shape of the tool engagement portion 19 may be a Bi-HEX (modified dodecagon) shape (ISO22977:2005(E)) or the like.

Moreover, assuming that the distance from the tip end of the metal shell 3 to the seat portion 16 along the axis CL1 is L, the anti-seizing agent 34 may be applied to 80% or more of the outer peripheral surface region of the metal shell 3 located between the tip end of the metal shell 3 and a location L/3 on the rear end side along the axis CL1 (the entire region from the tip end of the metal shell 3 to the rear end of the externally threaded portion 15, for example).

Furthermore, such a configuration may be possible in which the nickel layer 31 contains phosphorus (P) and the concentration of P in the portion in which the concentration of Ni is 50 at % in the thickness direction of the nickel layer 31 is 6 at % or more and 20 at % or less (more preferably, 8 at % or more and 15 at % or less).

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

Having described the invention, the following is claimed:

1. A spark plug comprising:

a tubular metal shell extending in an axial direction, wherein the metal shell includes:

an externally threaded portion formed on a tip end side of an outer periphery of the metal shell;

a seat portion formed on a rear end side of the externally threaded portion in the axial direction and protruding radially outward; and a nickel layer provided on an outer surface of the metal shell, the nickel layer containing phosphorus, wherein a phosphorus concentration in a portion in which a nickel concentration is 50 at % in a thickness direction of the nickel layer itself is 6 at % or more and 20 at % or less.

2. The spark plug according to claim 1, wherein the phosphorus concentration in the portion in which the nickel concentration is 50 at % in the thickness direction of the nickel layer is 8 at % or more and 15 at % or less.

3. The spark plug according to claim 1, wherein the metal shell includes a trivalent chromate layer provided on the nickel layer, wherein the trivalent chromate layer includes a chromium component, and 95 mass % or more of the chromium component is trivalent chromium.

4. The spark plug according to claim 1, wherein the metal shell includes an antirust oil layer containing at least one kind of carbon, barium, calcium, sodium, and sulfur.

5. The spark plug according to claim 1, wherein when a distance along the axis from the tip end of the metal shell to the seat portion is L, an anti-seizing agent is applied to 80% or more of an outer peripheral surface region between the tip end of the metal shell and a location L/3 apart from the tip end along the axis, and the anti-seizing agent contains a medium including an organic hydrocarbon component, carbon, and at least one kind of nickel, aluminum, zinc, and copper.

6. The spark plug according to claim 1, wherein the number of pin holes per unit surface area in the nickel layer is 60 points/$cm^2$ or less.

* * * * *